US009928931B2

(12) United States Patent
Bender

(10) Patent No.: US 9,928,931 B2
(45) Date of Patent: Mar. 27, 2018

(54) CONTACT MATERIAL

(71) Applicant: UMICORE TECHNICAL MATERIALS AG & CO. KG, Hanau-Wolfgang (DE)

(72) Inventor: Michael Bender, Aschaffenburg (DE)

(73) Assignee: UMICORE TECHNICAL MATERIALS AG & CO. KG, Hanau-Wolfgang (DE)

( * ) Notice: Subject to any disclaimer, the term of this patent is extended or adjusted under 35 U.S.C. 154(b) by 161 days.

(21) Appl. No.: 14/388,171

(22) PCT Filed: Mar. 26, 2013

(86) PCT No.: PCT/EP2013/056345
§ 371 (c)(1),
(2) Date: Sep. 25, 2014

(87) PCT Pub. No.: WO2013/144112
PCT Pub. Date: Oct. 3, 2013

(65) Prior Publication Data

US 2015/0060741 A1 Mar. 5, 2015

(30) Foreign Application Priority Data

Mar. 26, 2012 (EP) ..... 12161247

(51) Int. Cl.
*H01B 1/02* (2006.01)
*B22F 9/04* (2006.01)
(Continued)

(52) U.S. Cl.
CPC ..... *H01B 1/02* (2013.01); *B22F 3/20* (2013.01); *B22F 9/04* (2013.01); *C22C 1/051* (2013.01);
(Continued)

(58) Field of Classification Search
CPC ..... H01B 1/02
See application file for complete search history.

(56) References Cited

U.S. PATENT DOCUMENTS 3,933,485 A 1/1976 Shibata
4,072,515 A 2/1978 Motoyoshi et al.
(Continued)

FOREIGN PATENT DOCUMENTS

DE 2428147 A1 2/1975
DE 2754335 A1 6/1978
(Continued)

OTHER PUBLICATIONS

Investigation into the switching behaviour of new silver-tin oxide contact materials. Proceedings of the 14th International Conference on Electrical Contacts, Paris, Jun. 20-24, 1988, pp. 405-409.
(Continued)

*Primary Examiner* — William Young
(74) *Attorney, Agent, or Firm* — Smith, Gambrell & Russell, LLP

(57) ABSTRACT

A process for producing a cadmium free electrical contact material having at least one metal and magnesium stannate $Mg_2SnO_4$. The process includes mixing pulverulent magnesium stannate $Mg_2SnO_4$ or a mamesium stannate precursor compound with at least one metal powder and optionally further oxides, pressing the mixture in order to obtain a compact and sintering the compact to obtain a sintered body.

17 Claims, 2 Drawing Sheets

(51) Int. Cl.

| | |
|---|---|
| ***C22C 1/05*** | (2006.01) |
| ***C22C 5/06*** | (2006.01) |
| ***C22C 29/12*** | (2006.01) |
| ***C22C 32/00*** | (2006.01) |
| ***B22F 3/20*** | (2006.01) |
| ***H01B 13/00*** | (2006.01) |
| *B22F 3/04* | (2006.01) |
| *H01H 1/0237* | (2006.01) |

(52) U.S. Cl.

CPC ..... *C22C 5/06* (2013.01); *C22C 29/12* (2013.01); *C22C 32/001* (2013.01); *H01B 13/0016* (2013.01); *H01H 1/0237* (2013.01); *B22F 3/04* (2013.01); *H01H 1/02376* (2013.01)

(56) References Cited

U.S. PATENT DOCUMENTS

| | | | | |
|---|---|---|---|---|
| 4,141,727 | A | | 2/1979 | Shida et al. |
| 4,647,477 | A | * | 3/1987 | DeLuca ..... C04B 37/006 205/162 |
| 4,680,162 | A | | 7/1987 | Shibata |
| 4,695,330 | A | | 9/1987 | Shibata |
| 5,610,347 | A | | 3/1997 | Behrens et al. |
| 5,822,674 | A | | 10/1998 | Behrens et al. |
| 5,985,440 | A | | 11/1999 | Weise et al. |
| 8,749,330 | B2 | | 6/2014 | Heinrich et al. |

FOREIGN PATENT DOCUMENTS

| | | | |
|---|---|---|---|
| DE | 2952128 | A1 | 6/1981 |
| DE | 4319137 | A1 | 12/1993 |
| DE | 4331526 | A1 | 3/1994 |
| DE | 19607183 | C1 | 4/1997 |
| DE | 102009059690 | A1 | 6/2011 |
| EP | 0508055 | A1 | 10/1992 |
| EP | 1505164 | A2 | 2/2005 |
| JP | S5019352 | B1 | 7/1975 |
| JP | H01312046 | A | 12/1989 |
| WO | 93/26021 | A1 | 12/1993 |
| WO | 2011/086167 | A1 | 7/2011 |

OTHER PUBLICATIONS

International Search Report for PCT/EP2013/056345 dated Aug. 2, 2013 (German with English Translation) 7 pages.

Written Opinion of the International Search Authority for PCT/EP2013/056345 dated Sep. 26, 2014 (German with English Translation) 10 pages.

International Preliminary Report on Patentability for PCT/EP2013/056345 dated Oct. 1, 2014 (German with English Translation) 12 pages.

Kitaura, Mamoru et al. Characterization of zinc magnesium stannate phosphor fine particles synthesized by electromagnetic wave heating. Journal of Vacuum Science and Technology: Part B 28 (2) Mar./Apr. 2010. pp. C2C20-C2C25.

Database WPI Section Ch, Week 197531 Thomson Scientific, London, GB; AN 1975-51740W XP002703252, -& JP 50 019352 B (Sumitomo Electric Ind Co) Jul. 5, 1975 (Jul. 5, 1975) (1 Page).

Connor, P.A. et al. Novel tin oxide spinel-based anodes for Li-ion batteries. Journal of Power Sources 97-98 (2001), pp. 223-225.

Azad, Abdul-Majeed et al. Mg2SnO4 ceramics I. Synthesis-processing-microstructure correlation. Ceramics International 27 (2001), pp. 325 to 334.

Al-Shahrani, A.A. Sintering behavior and thermal property of $Mg_2SnO_4$. Materials in Electronics, 16, 2005, pp. 193 to 196.

* cited by examiner

CONTACT MATERIAL

For the production of electrical contacts in low-voltage switch devices, silver/metal and silver/metal oxide composite materials have been found to be useful. The most frequently used silver/metal composite material is silver/nickel, for which the main field of use is at relatively low currents.

Particular additives, such as $WO_3$, or $MoO_3$, have been found to be useful in switch devices that have to withstand high thermal loads. $AgSnO_2$ has been found to be particularly useful with these additives in switch devices at nominal currents of more than 100 A and under what is called AC4 load. At lower switching currents, however, the lifetime of these materials is relatively short.

The $AgSnO_2WO_3/MoO_3$ material is produced by powder metallurgy via the extrusion technique. Powder metallurgy production has the advantage that additives of any kind can be used in any amount. Thus, the material can be optimized for particular properties, for example welding power or heating. In addition, the combination of powder metallurgy with the extrusion technique allows particularly high economic viability in the production of the contact parts.

An internally oxidized $AgSnO_2/In_2O_3$ material is likewise used. This material, described in DE-A 24 28 147, contains, as well as 5-10% $SnO_2$, also 1-6% $In_2O_3$. A controlled change in the concentrations of the oxide additives, in order to influence particular switching properties, is frequently impossible because of the oxidation kinetics. DE-A 27 54 335 describes a contact material which, as well as silver, contains 1.6 to 6.5 $Bi_2O_3$ and 0.1 to 7.5 $SnO_2$. This material can be produced either via internal oxidation or by powder metallurgy. Such high $Bi_2O_3$ contents lead, however, to embrittlement, such that the material can be produced only via individual sintering, and not via the more economically viable extrusion technique.

U.S. Pat. No. 4,680,162 discloses an internally oxidized $AgSnO_2$ material which, with tin contents of more than 4.5%, can contain additions of 0.1-5 indium and 0.01-5 bismuth. The metal alloy powder is compacted and then internally oxidized. These additions prevent the inhomogeneous oxide deposits which are customary in internal oxidation. However, this material does not exhibit optimal contact properties.

The publication "Investigation into the Switching behaviour of new silver-tin oxide contact materials in Proc, of the 14th Int. Conf. on El. Contacts, Paris, 1988 June 20-24, p. 405-409" reports the switching characteristics of electrical contacts made from silver-tin oxide, produced by powder metallurgy, which may contain a further two oxides from the group of bismuth oxide, indium oxide, copper oxide, molybdenum oxide and tungsten oxide, although the exact composition of these materials is not stated. U.S. Pat. No. 4,695,330 describes a specific process for producing an internally oxidized material having 0.5-12 tin, 0.5-15 indium and 0.01-1.5 bismuth.

The production of contact materials based on silver-tin oxide by powder metallurgy, by mixing the powders, cold isostatic pressing, sintering and extrusion to give the semi-finished product, is known, for example, from DE 43 19 137 and DE 43 31 526. U.S. Pat. No. 4,141,727 discloses contact materials made from silver, comprising bismuth-tin oxide as mixed oxide powder. In addition, DE 29 52 128 discloses calcining the tin oxide powder at 900° C. to 1600° C. before mixing it with silver powder.

Because of rising demands on the contact materials, the known materials do not meet the demands in all cases or for all applications.

DESCRIPTION

Figure 1:
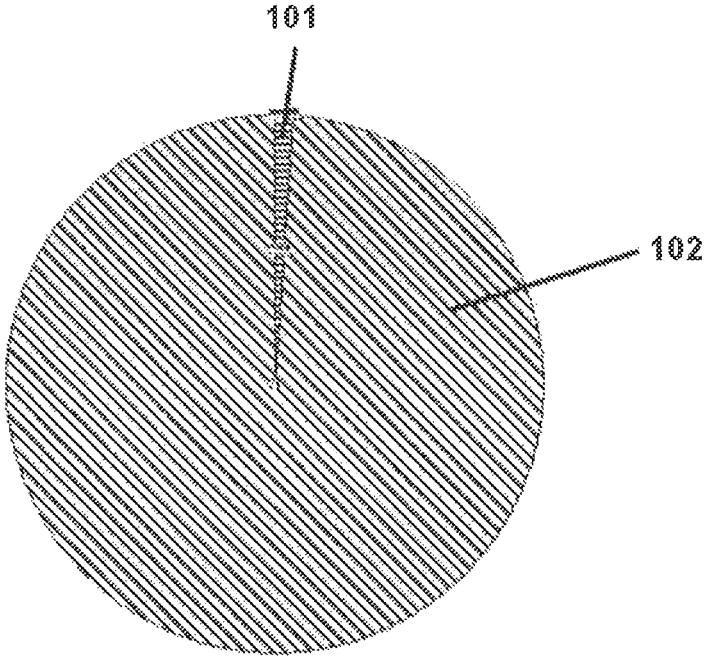
FIG. 1 shows an obtained mixture of a magnesium stannate and magnesium oxide.

1. An electrical, cadmium-free contact material comprising at least one metal and magnesium stannate $Mg_2SnO_4$.
2. The contact material as claimed in point 1, wherein the metal is silver or a silver alloy.
3. The contact material as claimed in point 1 or 2, wherein 0.2 to 60 percent by volume of magnesium stannate is present.
4. The contact material as claimed in one or more of points 1 to 3, wherein 5% by weight to 60% by weight of magnesium stannate is present.
5. The contact material as claimed in one or more of points 1 to 3, wherein 0.5% by weight to 13% by weight of magnesium stannate is present.
6. The contact material as claimed in one or more of points 1 to 3, wherein 0.5% by weight to 5% by weight of magnesium stannate is present.
7. The contact material as claimed in one or more of points 1 to 6, wherein at least 60% by weight of the magnesium stannate present in the contact material has a particle size of 1 μm or more.
8. The contact material as claimed in one or more of points 1 to 7, wherein all or some of the magnesium stannate present in the contact material has a particle size of 20 nm to 1 μm.
9. The contact material as claimed in one or more of points 1 to 8, wherein all or some of the magnesium stannate present in the contact material has a particle size of 100 nm to 900 nm.
10. The contact material as claimed in one or more of points 1 to 9, comprising further oxides.
11. The contact material as claimed in one or more of points 1 to 10, wherein oxides from the group consisting of magnesium oxide, copper oxide, bismuth oxide, tellurium oxide, tin oxide, indium oxide, tungsten oxide, molybdenum oxide, mixed oxides thereof or combinations thereof are additionally present.
12. The contact material as claimed in one or more of points 1 to 11, wherein the further oxides, individually or in combination, may be present in amounts of 0,5% by weight to 30% by weight.
13. The contact material as claimed in one or more of points 1 to 12, wherein the further oxides, individually or in combination, may be present in amounts of 2% by weight to 20% by weight or of 0.5% by weight to 7% by weight.
14. The contact material as claimed in one or more of points 1 to 13, wherein further oxides used are tin oxide, optionally together with indium oxide and/or tellurium oxide.
15. The contact material as claimed in one or more of points 1 to 14, wherein at least 60% by weight of the further oxides present in the contact material has a particle size of 1 μm or more.

16. The contact material as claimed in one or more of points 1 to 14, wherein the further oxides have particle sizes of 20 nm to 2 μm or 50 nm to less than 2000 nm, or 100 nm to 1800 nm or 200 nm to 900 nm.
17. The contact material as claimed in one or more of points 1 to 14, wherein 60% of the further oxides has particle sizes of 100 nm to 900 nm.
18. The contact material as claimed in one or more of points 1 to 17, wherein the total oxide content is up to 60% by weight.
19. The contact material as claimed in one or more of points 1 to 18, obtainable by powder metallurgy production.
20. The use of a contact material as claimed in one or more of points 1 to 19 for production of electrical contact parts.
21, An electrical contact comprising a contact material as claimed in one or more of points 1 to 19.
22. A moving switch part of a switch device or electrical switch device, comprising an electrical contact as claimed in point 21.
23. A process for producing a contact material from metal and magnesium stannate $Mg_2SnO_4$ by mixing pulverulent magnesium stannate $Mg_2SnO$ or a magnesium stannate precursor compound with at least one metal powder and optionally further oxides, pressing the mixture in order to obtain a compact and sintering the compact to obtain a sintered body.
24. The process as claimed in point 23, wherein the sintered body obtained is formed, especially extruded, in a further process step.
25. The process as claimed in point 23, wherein the sintered body is a contact part,
26. The process as claimed in point 25, wherein the sintered body additionally comprises copper oxide.
27. A contact material obtainable by a process as claimed in either of points 23 and 24.

DETAILED DESCRIPTION

The problem addressed was that of providing a novel metal composite material which, when used as a contact material in electrical switch devices, compared to commonly used silver-based silver-tin oxide composite materials, exhibits improved arc erosion characteristics and lower contact resistance. This problem is solved by a metal composite material comprising at least one metal and magnesium stannate. Magnesium stannate, $Mg_2SnO_4$, is a compound known from literature, the preparation of which is described, for example, in Materials in Electronics, 16 (2005), pages 193 to 196, Journal of Power Sources 97-98 (2001), pages 223-225 or Ceramics International 27 (2001), pages 325 to 334. To prepare this compound, magnesium oxide MgO and tin oxide $SnO_2$ can be mixed vigorously in the appropriate molar ratio (i.e. $MgO:SnO_2=2:1$) (for example by wet or dry grinding), optionally dried and then calcined at temperatures of about 1200° C. to about 1600° C. for about 15 to about 25 hours. No particular demands are generally made on the atmosphere, and so it is possible to calcine under air. In this way, a mixture of magnesium stannate and magnesium oxide can be obtained, as shown in FIG. 1, with about 4.4% magnesium oxide present along with about 95.6% magnesium stannate. By using an excess of about 10% magnesium oxide, it is possible to achieve up to 98% magnesium stannate $Mg_2SnO_4$.

The present patent application also relates to the use of a contact material comprising at least one metal and magnesium stannate for production of electrical contact parts, and to electrical contacts comprising such a contact material, as described hereinafter.

Metals used may especially be silver or silver alloys. Silver-nickel alloys, for example, are of good suitability, Silver alone likewise has excellent properties for many end uses, Cadmium, in contrast, is not present and may be present within the range of unavoidable impurities at most. Magnesium stannate can generally be used in amounts of 0.02% to 60% by volume, or 0.02% by volume, especially 0.2% by volume, to 25% by volume, (=to 13% by weight), especially 2% by volume, to 25% by volume, or 0.02% by volume, especially 0.2% by volume, to 60% by volume (=to 40% by weight), especially 2% by volume, to 60% by volume. or 0.02% by volume, especially 0.2% by volume, to 5% by volume (=to 2.34% by weight), The amounts of magnesium stannate $Mg_2SnO_4$ to be added may be selected in advantageous amounts according to the use, where the addition of about 0.02% by volume to 25% by volume (=0-13% by weight) or 0.5% by weight to 13% by weight for extruded materials, 0.02% by volume to 60% by volume (=0-40% by weight) or 0.5% by weight to 40% by weight in the case of individually pressed materials (similarly to known Ag/W and Ag/WC materials). In the case of use of magnesium stannate $Mg_2SnO_4$ as additive, 0.5% by weight to 5% by weight, or 0.5% by weight to 1% by weight or 1% by weight to 2.5% by weight or 0.02% by volume to 5% by volume (=0-2.34% by weight) is particularly suitable. The magnesium stannate $Mg_2SnO_4$ is present in the contact material as a disperse phase, while the metal forms the continuous phase. The magnesium stannate $Mg_2SnO_4$ may have particle sizes of at least 1 μm. More particularly, at least 60% of the magnesium starmate has particle sizes of 1 μ or more, which is especially advantageous in the case of further processing in a forming operation, for example by extrusion. If contact parts are sintered individually, it is possible also to use, instead or in combination with magnesium $Mg_2SnO_4$ having a particle size of 1 μ or more, particle sizes of 20 nm to 1 μm or 50 run to less than 1000 nm, especially 100 nm to 900 nm. In this case, advantageously 60% of the magnesium stannate has particle sizes of 100 nm to 900 nm.

In addition, the contact material may include further oxides. More particularly, the contact material may additionally comprise oxides from the group consisting of magnesium oxide, copper oxide, bismuth oxide, tellurium oxide, tin oxide, indium oxide, tungsten oxide, molybdenum oxide or combinations thereof, mixed oxides thereof or combinations thereof. An example of a mixed oxide present may be $Bi_6WO_{12}$.

The above oxides may be present, individually or altogether, in amounts of 0.5% by weight to 30% by weight, or in amounts of 2% by weight to 20% by weight, to up to 7% by weight, especially up to 2% by weight, or in amounts of 0.5% by weight to up to 7% by weight or in amounts of 0,5% by weight up to 2% by weight. In one embodiment, tin oxide is used, optionally together with indium oxide, tellurium oxide or both as further oxides. In a further embodiment, the total oxide content, i.e. the combined content of magnesium stannate $Mg_2SnO_4$, is up to 60% by weight.

In one embodiment, at least 60% of the further oxide, i.e., for example, of the tin oxide, has particle sizes of 1 μm or more, which is especially advantageous in the case of further processing in a forming operation, for example by extrusion.

In one embodiment, the further oxide may also be used particle sizes of 20 nm to 2 μm or 50 nm to less than 2000 nm, especially 100 nm to 1800 nm or 200 nm to 900 nm. In this case, 60% of the further oxide advantageously has particle sizes of 100 nm to 900 nm.

The contact material can be obtained by a production method selected from powder metallurgy production, internal oxidation or combinations thereof.

In the case of production of the material by powder metallurgy, the contact material is obtained by mixing a powder of the metal or an alloy with magnesium stannate $Mg_2SnO_4$ or a magnesium stannate precursor compound and optionally further oxides, cold isostatic pressing of the powder mixture, and sintering at temperatures of about 500° C. to about 940° C., and optionally forming the sintered material, for instance by extrusion to give wires or profiles. Magnesium stannate precursor compounds used may be compounds other than magnesium stannate which break down under the process conditions to give magnesium stannate and possibly further breakdown products. The further breakdown products must be either volatile under the process conditions or be substances whose presence does not disrupt the properties of the product obtained, ideally substances whose presence is desired, such as the metal used or a further oxide from the group consisting of magnesium oxide, copper oxide, bismuth oxide, tellurium oxide, tin oxide, indium oxide. tungsten oxide, molybdenum oxide or combinations thereof, mixed oxides thereof or combinations thereof. Suitable compounds are, for example, alkoxides of tin and magnesium, for example hexakis[μ-(2-methyl-2-propanolato)]bis[(2-methyl-2-propanolato)tin]dimagnesium, CAS No. 139731-82-1.

It is advisable for the magnesium stannate used or the magnesium stannate precursor compound and/or further oxides already to have the desired particle size or particle size distribution prior to mixing with the powder of the metal or an alloy, for example silver powder, or to already have, to an extent of more than 60% by weight, a particle size of more than 1 μm prior to mixing with the powder of the metal or an alloy, for example silver powder. In this case, excessively fine magnesium stannate or else other oxides can be coarsened by a heat treatment, by calcining, for example, at temperatures of about 700° C. to about 1400° C., until more than 60% by weight of the magnesium stannate and of the further oxides has a particle size of more than 1 μm. The use of these coarsened oxide powders, after the compacts have been sintered, gives a material which is more ductile than materials having lower oxide particle sizes and can therefore be formed more easily, which may be advantageous in the case of further reforming treatment, for example extrusion. In the case of individual sintering of contacts, it is also possible, as described above, to use magnesium stannate ($Mg_2SnO_4$) powders having relatively small particle sizes, in which case additives such as sintering activators are advantageous, for example copper oxide CuO, nanoscale silver powder or other nanomaterials. In this case, it is of course also possible to use magnesium stannate in which 60% by weight already has a particle size of at least 1 μm prior to mixing with the metal powder, but also magnesium stannate ($Mg_2SnO_4$) in which 60% of the magnesium stannate has particle sizes of 50 nm to less than 1000 nm, or especially 60% of the magnesium stannate has particle sizes of 100 nm to 900 nm.

In the case of production by internal oxidation, for example, an alloy of silver with base metals is produced by pyrometallurgy and is often heat-treated under pressure in pure oxygen, so as to form a contact material. Processes of this kind are known from literature and are described, for example, in EP 1505164 and EP 0508055.

In the case of production by internal oxidation in combination with production by powder metallurgy, it is possible to use, for example in the form of powder of the metal or of an alloy, a metal powder comprising, for example, further oxides which have been produced by internal oxidation, for example silver having a content of tin oxide. In that case, the further processing proceeds by powder metallurgy, i.e. by addition of magnesium stannate and/or further oxides and/or metal powder, and subsequent pressing, sintering and optional forming, for example extrusion.

In one embodiment, the contact material especially comprises silver and magnesium stannate and additionally only typical impurities, In one embodiment, the contact material contains magnesium stannate in an amount of 0.2 to 20% by weight and, to 100% by weight, silver and typical impurities.

In a further embodiment of the invention, the contact material comprises magnesium stannate which, to an extent of at least 60%, has a particle size of 1 μm or more, in an amount of 0.2 to 20% by weight and, to 100% by weight, silver and typical impurities.

EXAMPLES

Example 1

Preparation of Magnesium Stannate 13.03 g of $SnO_2$ and 6.97 g of MgO were weighed and then subjected to wet grinding at 250 rpm for 2×5 minutes (Fritsch Pulverisette 5, 2 mm $ZrO_2$ balls, dry isopropanol).

The powder mixture is dried in a drying cabinet (temperature) and then comminuted with a mortar and pestle.

The comminuted powder mixture is calcined under air at 1400° C. for 20 hours and then ground down to a particle size (d50) of 2 μm (Fritsch Pulverisette 5, 2 mm $ZrO_2$ balls, dry isopropanol). By x-ray diffraction on the reaction product and Rietveld refinement, it was found that the product formed consists to an extent of 95.6% of dimagnesium stannate ($Mg_2SnO_4$) and to an extent of 4.4% of cassiterite ($SnO_2$).

Production of the contact material comprising $Mg_2SnO_4$ 914.4 g of silver powder (Umicore, atomized silver powder, screened to <42 μm) are mixed with 17.07 percent by volume of $Mg_2SnO_4$ powder (85.6 g) in a mixing unit (MTI mixer, 8 min., 1000 rpm). The powder mixture is transferred into a plastic cylindrical mold and subjected to cold isostatic pressing at a pressure of 800 bar to give a bar. This bar is sintered at 820° C. for 2 h and then extruded.

Comparative Example 2

Production of the Contact Material Comprising $SnO_2$ 880 g of silver powder (same silver powder as in example 1) are mixed with 120 g, corresponding to 17.07% by volume, of $SnO_2$ powder in a mixing unit (MTI mixer, 8 min., 1000 rpm). The powder mixture is transferred into a plastic cylindrical mold and subjected to cold isostatic pressing at a pressure of 800 bar to give a bar. This bar is sintered at 820° C. for 2 h and then extruded.

Samples of the two contact materials were used to conduct tensile tests according to EN ISO 6892-1, and the elongation at break of the two contact materials was determined to be 27%.

The contact materials produced are used to produce contact parts by extrusion (5 mm wire, semifinished product, is soldered on and trimmed, then incorporated into a switch), and these contact parts are used to conduct switching tests in a circuit breaker having 500 switches, a current of 350 A and blowout field: 30 mT/kA. The results are shown in FIGS. 2 and 3.

Figure 2:
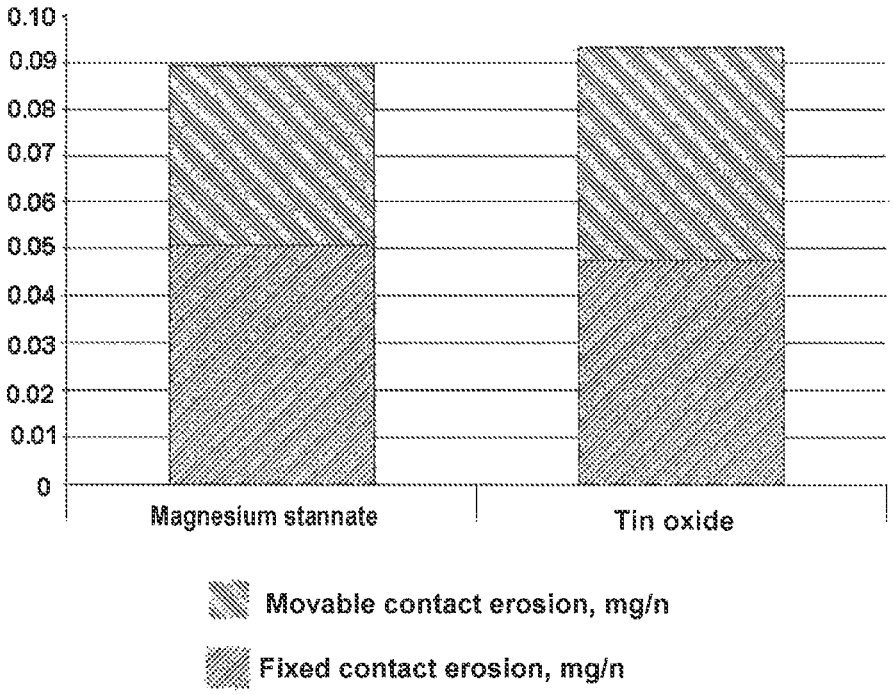
FIG. 2 shows switch operation erosion test results.

FIG. 2 shows, for both contact materials each having an oxide content of 17.07 percent by volume, the erosion in mg per switching operation. The lower column in each case shows the change in the fixed contact, the upper column that on the moving contact.

It is clear that the contact material based on magnesium stannate ($Mg_2SnO_4$) and silver shows improved erosion properties.

Figure 3:
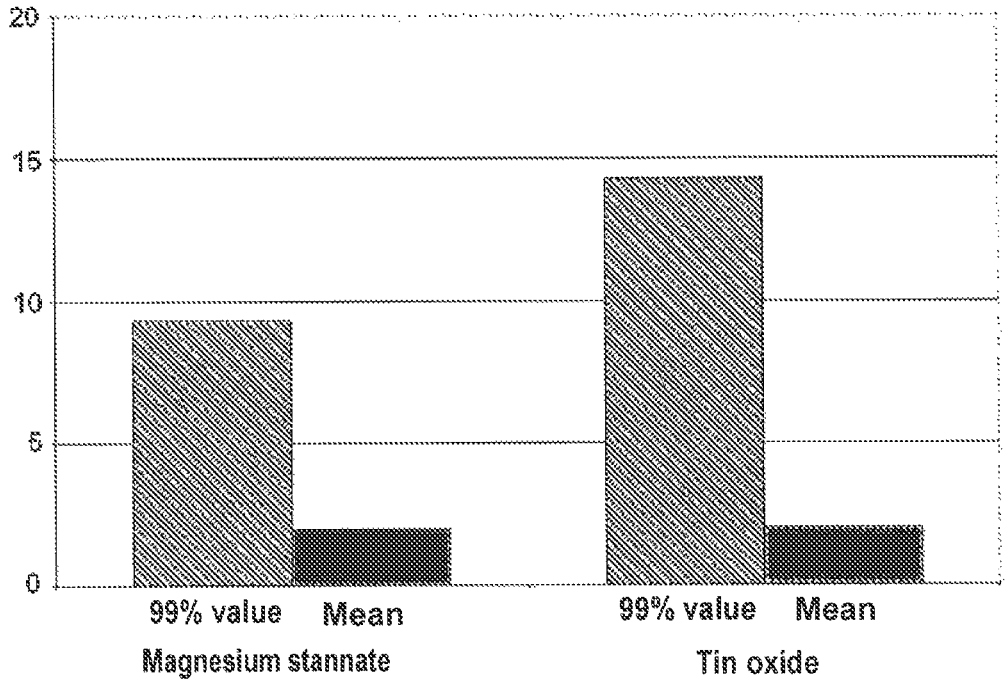
FIG. 3 shows the contact resistances for two contact materials.

FIG. 3 shows the contact resistances for the two contact materials in mOhm, which are reported as mean values (right-hand column in each case) and as 99% values. It is clear that the mean values are comparable, but the 99% values are much lower in the case of the contact material based on magnesium stannate ($Mg_2SnO_4$) and silver, and hence are considerably improved over the silver-tin oxide material.

The invention claimed is:

1. A process for producing a cadmium free electrical contact material comprising at least one metal and magnesium stannate $Mg_2SnO_4$, said process comprising mixing pulverulent magnesium stannate $Mg_2SnO_4$ or a magnesium stannate precursor compound with at least one metal powder and optionally further oxides, pressing the mixture in order to obtain a compact and sintering the compact to obtain a sintered body.

2. The process as claimed in claim 1, wherein the sintered body obtained is subjected to a reforming step.

3. The process as claimed in claim 1, wherein the sintered body is a contact part.

4. The process as claimed in claim 3, wherein the mixing includes mixing in at least one further oxide that includes copper oxide such that the sintered body additionally comprises copper oxide.

5. The process as claimed in claim 2 wherein the reforming step includes reforming by extrusion.

6. The process as claimed in claim 1, wherein the metal is silver or a silver alloy.

7. The process as claimed in claim 1, wherein the mixture comprises 0.2 to 60 percent by volume of magnesium stannate.

8. The process as claimed in claim 1, wherein the mixture comprises 5% by weight to 60% by weight of magnesium stannate.

9. The process as claimed in claim 1, wherein at least 60% by weight of the magnesium stannate present in the contact material has a. particle size of 1 μm or more.

10. The process as claimed in claim 1, wherein all or some of the magnesium stannate present in the contact material has a particle size of 20 nm to 1 μm.

11. The process as claimed in claim 1, wherein the mixing includes mixing in at least one further oxide selected from the group consisting of magnesium oxide, copper oxide, bismuth oxide, tellurium oxide, tin oxide, indium oxide, tungsten oxide, molybdenum oxide, mixed oxides thereof or combinations thereof.

12. The process as claimed in claim 1, wherein the contact material comprises 0.5% by weight to 40% by weight of magnesium stannate.

13. The process as claimed in claim 12, wherein the metal is silver or silver alloy.

14. The process as claimed in claim 1, wherein the contact material comprises 0.5% by weight to 13% by weight of magnesium stannate.

15. A method of producing an electrical contact part, comprising:

producing a cadmium free electrical contact material, comprising at least one metal and magnesium stannate $Mg_2SnO_4$, by mixing pulverulent magnesium stannate $Mg_2SnO_4$ or a magnesium stannate precursor compound with at least one metal powder and optionally further oxides, pressing the mixture in order to obtain a compact, and sintering the compact to obtain a sintered body; and reforming the sintered body to form an electrical contact part.

16. The method of claim 15, wherein reforming the sintered body includes extrusion into a wire and trimming of the wire.

17. A method of producing a moving switch part of a switch device or electrical switch device, comprising:

producing a cadmium free electrical contact material, comprising at least one metal and magnesium stannate $Mg_2SnO_4$, by mixing pulverulent magnesium stannate $Mg_2SnO_4$ or a magnesium stannate precursor compound with at least one metal powder and optionally further oxides, pressing the mixture in order to obtain a compact, and sintering the compact to obtain a sintered body; and reforming the sintered body to form a moving switch part.

* * * * *